United States Patent [19]

Chao et al.

[11] 4,434,064

[45] Feb. 28, 1984

[54] GRAPHITE DISPERSION

[75] Inventors: Tai S. Chao, Olympia Fields; Aubrey C. Smith, Jr., Harvey; Frederic D. Smies, Homewood, all of Ill.

[73] Assignee: Atlantic Richfield Company, Philadelphia, Pa.

[21] Appl. No.: 260,531

[22] Filed: May 4, 1981

[51] Int. Cl.[3] ..... C10M 1/20; C10M 1/32

[52] U.S. Cl. ..... 252/29; 252/51.5 A; 252/56 R

[58] Field of Search ..... 252/25, 29, 51.5 A, 252/56 R

[56] References Cited

U.S. PATENT DOCUMENTS

| | | | |
|---|---|---|---|
| 2,242,822 | 5/1941 | Fuchs | 44/51 |
| 2,590,733 | 3/1952 | Stillman | 252/29 UX |
| 3,384,580 | 5/1968 | Peace | 252/29 |
| 4,094,799 | 6/1978 | DeVrie et al. | 252/29 |
| 4,144,166 | 3/1978 | DeJovine | 252/29 |
| 4,203,728 | 5/1980 | Norton | 44/51 |

*Primary Examiner*—Jacqueline V. Howard

*Attorney, Agent, or Firm*—Stanley M. Welsh

[57] ABSTRACT

Disclosed is a method for stabilizing a graphite in-oil-dispersion by means of a fracture induced oxidation of graphite particles to produce a composition suitable as a constituent of a lubricating oil composition.

The oxygen content of the graphite particles is at least about 1% by weight of the total weight of the ground graphite particle including oxygen.

7 Claims, 1 Drawing Figure

Fig. 1 Effect of Dry Grinding Time on Particle Size, Oxygen Content & Stability
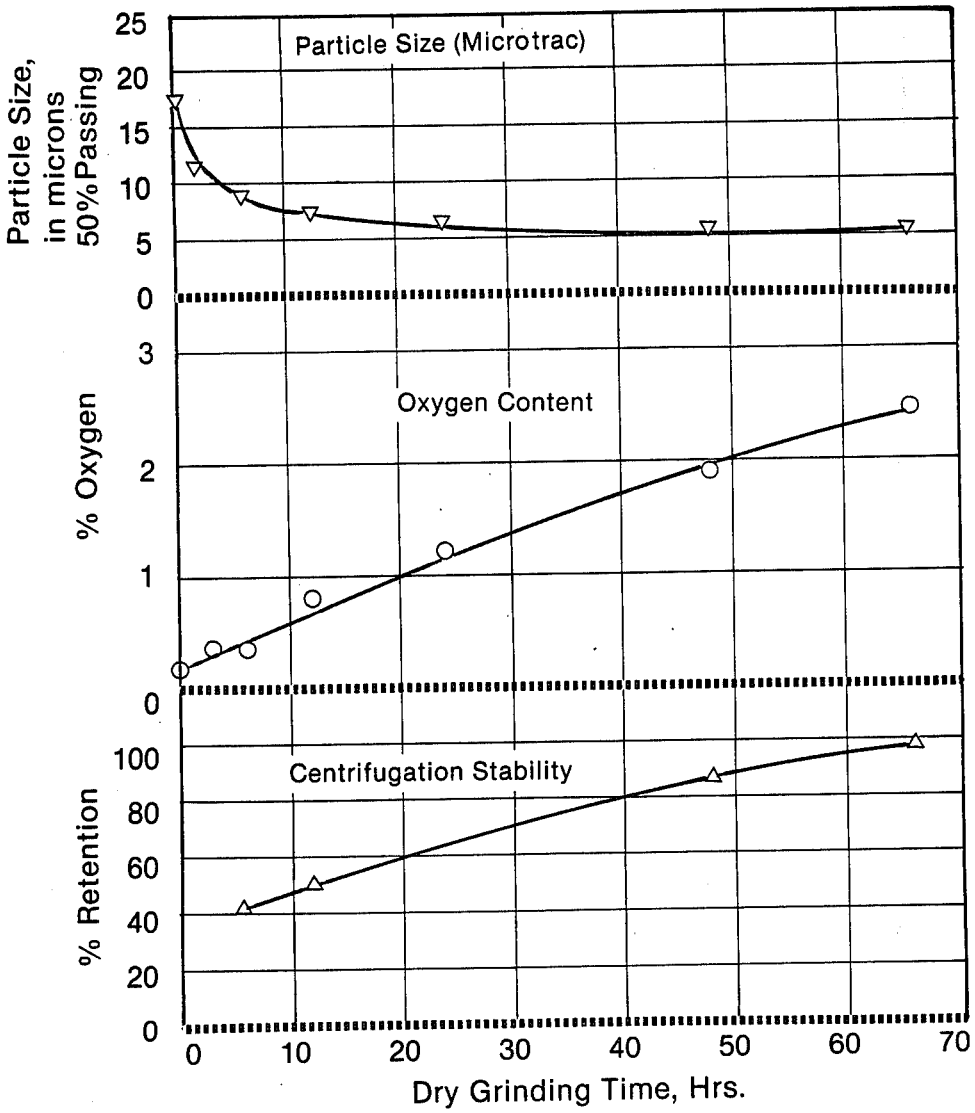

GRAPHITE DISPERSION

BACKGROUND OF THE INVENTION

Field of the Invention

The field of this invention relates to dispersions of particles in a liquid medium. More particularly, the field of this invention relates to dispersions of natural or synthetic graphite dispersions-in-oil which are suitable as a constituent of a lubricating composition.

U.S. Pat. No. 2,176,879 (1939) of F. E. Bartell discloses a composition comprising a dispersion of colloidal or finely divided graphite in a non-flocculated form in an organic liquid. A strongly absorbed stabilizing agent is disclosed to prevent flocculation.

U.S. Pat. No. 4,203,728 (1980) of Richard B. Norton discloses a method for preparing a slurry comprising oil and coal. Suspension stability of the coal particles in the oil is achieved by surface oxidation of the coal particle prior to preparation of the slurry. Surface oxidation of the coal could be achieved by techniques disclosed in Supplemental Volume of the text, "Chemistry of Coal Utilization" edited by H. H. Lowry, John Wiley and Son, N.Y. (1963). One of the techniques involved a fluidized bed of air and coal. Another, involved contacting coal particles with aqueous solutions of alkaline permanganate, hydrogen peroxide, ozone solutions and the like. Air oxidation in the range of 120°–350° C. was disclosed as an effective way to oxidize the surface of such coal particles.

Efforts to prepare stable graphite-in-oil dispersions by fluidized bed oxidation in air were not successful. By stable is meant, that the particles do not flocculate and/or settle out upon standing. To facilitate the process of settling, we used an International Model BE Centrifuge. A 100 ml. sample of the graphite dispersion was placed in the centrifuge and centrifugated at 900 RPM for 18 hours. A 5 ml. sample was syphoned out and its graphite content determined. From this, the percent of graphite retained was calculated and used to compare the stability of different dispersions. Stability as determined by this method is essential to the provision of an economical yield of stable graphite dispersions when the product of the wet grinding step is subjected to centrifugation or settling to remove undesirably large (e.g., greater than 6 microns) particles. It is also necessary to ensure, for example, that the lubricating properties of the graphite containing lubricating oil is not lost due to separation of graphite from the lubricating oil during long periods of storage, and that no graphite particles or their flocs will plug up pores of oil filters and lubrication passages.

The requirements for a graphite-in-oil dispersion for use in lubrication are more severe than the requirements for a coal-oil dispersion whose main purpose is transport through a pipeline. Since movement in a pipe helps maintain the coal suspended, the requirements for a coal slurry are likely to be different from those of a graphite in-oil-dispersion.

Accordingly, a method to prepare a stable graphite in-oil-dispersion which is an improvement over the methods previously known is needed.

BRIEF DESCRIPTION OF THE INVENTION

It is an object of this invention to provide a method for preparing a stable graphite in-oil-dispersion which is more stable than one prepared from a fluidized bed oxidation in air.

It is an object of this invention to provide a method involving fracture induced surface oxidation of graphite particles to produce very stable graphite-in-oil dispersions.

It is an object of this invention to provide an improved process involving at least two steps which give rise to greater yields and improved stability in graphite in-oil-dispersions.

Other objects of this invention will be clear based upon this disclosure.

BRIEF DESCRIPTION OF THE DRAWING

FIG. 1 is a graph showing the effect of dry grinding time on particle size, oxygen content and stability.

DESCRIPTION OF THE PREFERRED EMBODIMENT

This invention includes an improved process of grinding natural or synthetic graphite and producing a stable graphite-in-oil dispersion. This improved process involves at least two grinding steps: a dry grinding step in an oxygen-containing atmosphere to induce partial oxygen pickup and a wet grinding step in which dry ground graphite of a previous step is simultaneously reduced to essentially submicron size and dispersed in an oil. These are, optionally, but preferably followed by a separation step in which large particles (those having particles greater than about 6 microns in average diameter) are removed by centrifugation, sedimentation and/or other operations. One of the benefits achieved by this improved process is an increased yield of a stable dispersion subsequent to the separation step. We have found dispersion stability and yields to be strongly dependent on the oxygen content of the graphite. It was further discovered that the oxygen content of the graphite can be controlled by controlling the availability of oxygen or air during dry grinding, preferably in a ball mill.

A method of this invention involves the discovery that significant pick-up of oxygen can be made to occur during grinding of graphite in an oxygen-containing atmosphere, e.g., air, provided a sufficient oxygen-containing atmosphere is present and grinding is continued for a sufficient period of time.

It has been discovered that sufficiently stable graphite-in-oil dispersions can be obtained provided that over 90% of the particles by number of particles involved are below 1 micron in diameter, and more preferably over 95% of the particles by number of particles involved are below 1 micron in diameter, and as based upon the total weight of the graphite particle including oxygen, the percent by weight consisting of oxygen is at least about 1%, and preferably at least about 1.3%. An oxygen content of above about 7.0% by weight does not appear to provide any significant additional benefits in the way of dispersion stability as herein defined. In general, a percent by weight of oxygen in the range of about 1 to about 7% is satisfactory, and preferably about 1.3% to about 5% and still more preferably about 1.5% to about 3%.

It is believed that the reason that the amount of oxygen picked up, e.g., chemisorbed on the surface, during dry grinding of graphite is a critical factor with respect to stability of graphite-in-oil dispersions is that graphite surfaces so oxidized more strongly interact with graphite dispersants. In essence, the effectiveness of graphite dispersants are dramatically improved.

Base oils suitable for the preparation of dispersions of this invention include all base oils commonly used for the production of engine oils, industrial oils and other lubricating oils and lubricants. The choice of base oil is dependent mainly on the finished lubricant in question. For engine oils, paraffinic base oils such as these produced by solvent extraction and hydrogenation processes are preferred owing to their higher viscosity index and greater oxidation resistance. For industrial oils, naphthenic base oils are often preferred on account of their greater solubility for additives, lower cost, etc. Alternately, synthetic base oils such as polyalpha-olefins, dibasic acid esters or neopentylpolyol esters can be used where exceptional low temperature fluidity, long service life, higher viscosity index with lower volatility, cleanliness, etc. justify their higher cost.

When high viscosity and low volatility are required, oils which are commonly called bright stocks can be used.

Examples of paraffinic oils include solvent treated neutral oils having viscosity of 100–600 SUS (Sayboldt Universal Seconds) at 100° F. and VI (viscosity index) of 85–120. Base oils having similar viscosity characteristics but produced by the newer hydrocracking-hydrotreating processes can also be used.

Examples of naphthenic oils include what are commonly called pale oils of 60–2000 SUS at 100° F. and VI of 0–60. This includes naphthenic oils which have been twice hydrogenated to remove aromatic components and to improve color and stability.

Examples of bright stocks include base oils having viscosity of 2000–8000 SUS at 100° F. and VI of 60–100.

Examples of synthetic base oils include polyalphaolefins having viscosity of 2.5–10 centistokes at 210° F., di-2-ethyl hexyl azelate, di-isodecyl adipate, di-tridecyl adipate, trimethylpropane n-heptanoate, neopentylglycol pelargonate, and the like.

The choice of base oil is also dependent on the viscosity of the dispersion desired. In general, the dispersion should not be too viscous to impair its handling characteristics. This includes pumping, filtration, centrifugation, other purification operations, and blending operations. The preferred viscosity of a dispersion containing 10% graphite and used for engine oils is in the range of 100–500 centistokes at 100° F. Although viscosity of the dispersion can be controlled by a number of factors such as particle size and dispersant concentration, the viscosity of the base oil has a definite effect on the viscosity of the dispersion.

Generally speaking two classes of dispersants have been found to be useful for purpose of this invention.

The first class includes polymeric dispersants having average molecular weight of about 100,000–700,000. It includes two subclasses. The first subclass includes the copolymers of long-chain alkyl methacrylates or acrylates with polar monomers such as N-vinyl pyrrolidone, and N-dialkylamino ethyl acrylamide. Examples include Acryloid 940, Acryloid 954, Acryloid 957 and Texaco TL8103. Some examples of compounds within this first subclass are disclosed in U.S. Pat. Nos. 3,842,009 (1974) and 3,506,574 (1970) which are both expressly incorporated herein by reference.

The second subclass includes copolymers of two olefins, such as ethylene and propylene, to which a polar monomer such as N-vinyl pyrrolidone or 2-vinyl pyridine has been graft-polymerized. Examples include Acryloid 1155. The Acryloids named are products of Rohm & Haas.

Some examples of compounds within this second subclass can be found in U.S. Pat. No. 4,146,489 (1979) which is expressly incorporated by reference herein. Specifically disclosed in U.S. Pat. No. 4,146,489 (1979) among others is an oil soluble, substantially linear, rubbery hydrocarbon backbone polymer selected from ethylene/propylene copolymer and ethylene/propylene diene modified terpolymer, said backbone polymer having graft polymerized thereon monomer units selected from C-vinylpyridines and N-vinylpyrrolidone.

The ethylene-propylene copolymers may have a wide range of ethylene-propylene ratios. Above about 80 mole percent ethylene, the copolymers are partially crystalline, thus losing their oil solubility and their utility as substrates for this invention. Preferably, the ethylene-propylene substrates contain about 50 to about 70 mole percent ethylene, have viscosity average molecular weights of about 10,000 to about 200,000 and average Molecular Weight (by weight)/Molecular Weight (by number) of less than four. Lower propylene contents, higher molecular weights, and broader molecular weight distributions can be used but such copolymers lead to generally less efficient VI improvers.

The ethylene/propylene diene modified terpolymers are well known materials containing low levels (preferably less than 10% by weight) of a non-conjugated diene such as 1,4-hexadiene, dicyclopentadiene or ethylidenenorbornene. Maximum ethylene is determined by crystallinity (solubility) with the preferred range being about 45 to about 65 mole percent ethylene. Preferred viscosity average molecular weight is about 10,000 to about 200,000 with Molecular Weight (by weight)-/Molecular Weight (by number) of less than eight. Substrates outside of these ranges can be used at some sacrifice in properties of the VI improver made therewith.

The preferred monomer which is grafted to the olefinic backbone is 2-vinylpyridine. However, N-vinyl pyrrolidone or orther polar C-vinylpyridines may be used, such as 2-vinylpyridine, 4-vinylpyridine, and lower alkyl ($C_1$–$C_8$) substituted C-vinylpyridines, such as 2-methyl-5-vinylpyridine, 2-methyl-4-vinylpyridine, 2-vinyl-5-ethyl pyridine, and 2-vinyl-6-methylpyridine.

Other polar nitrogen containing grafting monomers may be used in minor amount with N-vinyl pyrrolidone or the C-vinylpyridines. These include dimethylaminoethyl methacrylate or acrylate, vinylimidazole, N-vinylcarbazole, N-vinylsuccinimide, acrylonitrile, o-, m-, or p-aminostyrene, maleimide, N-vinyl oxazolidone, N,N-dimethylaminoethyl vinyl ether, ethyl 2-cyanoacrylate, vinyl acetonitrile, N-vinylphthalimide, and 2-vinylquinoline; a variety of acrylamides and methacrylamides such as N-[1,1-dimethyl-3-oxobutyl] acrylamide, N-[1,2-dimethyl-1-ethyl-3-oxobutyl] acrylamide, N-(1,3-diphenyl-1-methyl-3-oxopropyl) acrylamide, N-(1-methyl-1-phenyl-3-oxobutyl) methacrylamide, N,N-diethylaminoethyl acrylamide, and 2-hydroxyethyl acrylamide. A variety of N-vinylcaprolactams or their thio- analogs, other than or in addition to N-vinylpyrrolidone, may be used in minor amounts. These include N-vinylthiopyrrolidone, 3-methyl-1-vinylpyrrolidone, 4-methyl-1-vinylpyrrolidone, 5-methyl-1-vinylpyrrolidone, 3-ethyl-1-vinylpyrrolidone, 3-butyl-1-vinylpyrrolidone, 3,3-dimethyl-1-vinylpyrrolidone, 4,5-dimethyl-1-vinylpyrrolidone, 4,5-dimethyl-1-vinylpyrrolidone, 5,5-dimethyl-1-vinylpyrrolidone, 3,3,5-trimethyl-1-vinylpyrrolidone, 4-ethyl-1-vinylpyrrolidone, 5-methyl-5-ethyl-1-vinylpyrrolidone, 3,4,5-trimethyl-3-ethyl-1-vinylpyrrolidone, and other lower alkyl substituted N-vinylpyrrolidones; N-vinylbenzyldimethylamine, N-dimethylaminopropyl acrylamide and methacrylamide, N-methacryloxyethylpyrrolidone, N-methacryloxyethylmorpholinone, N-methacryloxyethylmorpholine, N-maleimide of dimethylaminopropylamine, and the N-methacrylamide of aminoethylethyleneurea. "Minor amounts" of such graft monomers means less than 50% by weight of the monomer charge, for example about 10–30% by weight of the charge.

Any free radical source capable of hydrogen abstraction may be used as a catalyst (initiator) in the preparation. Examples are alkyl peroxy esters, alkyl peroxides, alkyl hydroperoxides, diacyl peroxides, and the like. While t-butyl perbenzoate is the preferred initiator, other examples which would be suitable include t-butyl peroctoate, di-tibutylperoxide, t-butyl-hydroperoxide, cumene hydroperoxide, or benzoyl peroxide. Any mixtures of such initiators may be used.

An example of copolymers of a methacrylate ester and an unsubstituted N-vinyl pyrrolidone included in the first subclass above are broadly a copolymer of a methacrylate ester and N-vinyl pyrrolidone of an average molecular weight of about 350,000 to about 600,000 corresponding to the formula:

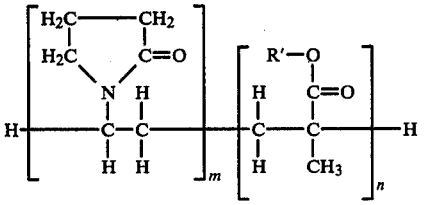

wherein R′ is a hydrocarbyl radical containing from 1 to about 22 carbon atoms; and the ratio of m:n is in the range of about 1:5 to about 1:15.

Another example of polymers in the above first subclass include copolymers of an acrylate ester and N-vinyl pyrrolidone included in the first subclass above. The N-vinyl pyrrolidone has the following structural formula prior to incorporation into the copolymers:

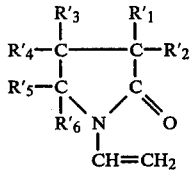

wherein $R_1'$, $R_2'$, $R_3'$ $R_4$, $R_5'$ and $R_6'$ are independently selected from the group consisting of hydrogen and a hydrocarbyl radical containing from 1 to 4 carbon atoms. Preferably, $R_5'$ and $R_6'$ are each hydrogen.

The acrylate ester has the following formula:

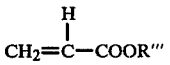

wherein R‴ represents an oil solubilizing group, such as a hydrocarbyl group or radical containing about 8 to about 24 carbon atoms. The hydrocarbyl group may be a straight chain or branched chain and preferably contains about 12 to about 18 carbon atoms.

Representative acrylic and methacrylic esters that promote oil solubility comprise octyl, decyl, isodecyl, dodecyl, isododecyl, myristyl, cetyl, stearyl, eicosyl and tetracosyl acrylates, and methacrylates.

The copolymer involving acrylates has a molecular weight in the range of about 100,000 to about 1,000,000 and preferably about 700,000 to about 900,000. The molar ratio of N-vinyl pyrrolidone to oil-soluble acrylic ester in the presently useful copolymers is preferably about 1:5 to about 1:15.

Representative N-vinyl pyrrolidones within the scope of the above formula that are useful include N-vinyl pyrrolidone itself, 3-methyl-1-vinyl pyrrolidone, 4-methyl-1-vinyl pyrrolidone, 5-methyl-1-vinyl pyrrolidone, 3-ethyl-1-vinyl pyrrolidone, 3-butyl-1-vinyl pyrrolidone, 3,3-dimethyl-1-vinyl pyrrolidone, 4,5-dimethyl-1-vinyl pyrrolidone, 5,5-dimethyl-1-vinyl pyrrolidone, 3,3,5-trimethyl-1-vinyl pyrrolidone, 4-ethyl-1-vinyl pyrrolidone, 5-methyl-5-ethyl-1-vinyl pyrrolidone, 3,4,5-trimethyl-3-ethyl-1-vinyl pyrrolidone, and other lower alkyl substituted N-vinyl pyrrolidones.

Also, within the scope of this invention are other cyclic N-vinyl amides such as N-vinyl caprolactam and its alkyl-substituted derivatives that may be included in the presently useful copolymers, e.g., cografted onto the oil-soluble polymeric backbone.

The other essential monomer of the presently useful copolymers is a material selected from alkyl acrylates, alkyl methacrylates or mixtures thereof with alkyl groups, e.g., hydrocarbyl radicals, of sufficient average size to ensure solubility of the copolymer, e.g., graft copolymer, in the present lubricating oil composition. Oil-soluble acrylic esters useful as monomers, e.g., for forming the backbone polymer in the case of graft copolymers, may be represented by the formula:

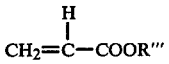

wherein R‴ represents an oil solubilizing group, such as a substantially hydrocarbyl radical containing about 8 to about 24 carbon atoms. The alkyl group may be a straight chain or brached chain and preferably contains about 12 to about 18 carbon atoms.

Terpolymers preferably partially depolymerized having viscosities in the range, for example of from about 1 to about 500 kilopoises have been found very useful in this invention. More specifically, the terpolymers which have been found to be satisfactory for use as stabilizing agents are polymers of the polymethylene type with a saturated main carbon chain, with methyl groups substituted for hydrogen at an overall average substitution rate of about one methyl for every four carbon atoms in the chain, or polymers of the same type having, in addition to the methyl substitution, occasional substitution of unsaturated diene groups. The combined substitution of diene groups and methyl groups when both are present should still be such that the substitution rate on the main carbon chain averages about one substitution for every four carbon atoms.

The second class of dispersant, which were found to be useful for this invention and which constitute the basis of a copending application, are termed non-polymeric dispersants. They have molecular weight in the range of about 1000–5000. Examples of such dispersants include Oronite 1200, a succinimide type dispersant sold by Chevron Chemical Company and Amoco 9250, a Mannich base type dispersant sold by Amoco Chemicals Corporation. More detail as to this second class of dispersant is given in a copending application.

Broadly the method for improving the yield and stability of a graphite-in-oil dispersion comprises at least two steps of grinding and then dispersing either natural or synthetic graphite. The grinding of the graphite consists of taking, for example, powders of about 100–350 mesh and grinding them to form graphite particles having an average diameter in the range of about 2 microns to about 15 microns and preferably in the range of about 5 microns to about 10 microns in the presence of an oxygen containing atmosphere so that these graphite particles have an oxygen content in the range of about 1% to about 7%, preferably about 1.3% to about 5%, and more preferably about 1.5% to about 3% of the total weight of the graphite particle including oxygen. The dispersing of the previously ground natural or synthetic graphite involves taking at least a portion of these graphite particles and stirring them into an oil to form a graphite-in-oil dispersion wherein the weight percent of said graphite particles is in the range, for example, of about 5% to about 50% and preferably about 10% to about 20% of the total weight of said graphite-in-oil dispersions. Dispersions having a weight percent of graphite less than 5% are possible, but decreasing the amount of graphite will increase the costs of transportation, storage and compounding into finished lubricating oil. On the other hand dispersions of graphite having a weight percent much in excess of about 30% are also possible, but increased concentrations of graphite can result in increased viscosity of the graphite-in-oil dispersion and decreased ease of handling.

A preferred method for grinding graphite powders for example of about 100 to about 350 mesh involves ball milling in the presence of a sufficient amount of oxygen containing atmosphere for a time sufficient, so that the resulting graphite particles will have an oxygen content in the range of about 1% to about 5% and a particle size small enough to form a stable dispersion. It has been found that ball milling of dry powders is the preferred method because attempts to cause similar amounts of oxygen content to be picked up by graphite particles by means of fluidized bed oxidation were unsuccessful as is shown in one of the examples. The ball milling, generally, requires in excess of 24 hours. However, grinding much in excess of 72 hours does not improve results or lead to any observable benefits.

An example of a preferred method for dispersing graphite in oil involves ball milling of a mixture of graphite particles having an average diameter in the range of about 2 microns to about 15 microns and preferably in the range of about 5 microns to about 10 microns with an oxygen content in the range of about 1% to about 7%, and preferably about 1.3% to about 5% and more preferably about 1.5% to about 3%.

A method for stabilizing the graphite-in-oil dispersion further involves removing some of the particles. Unusually stable graphite-in-oil dispersions have been obtained by of separating particles having an average diameter in excess of about 6 microns.

The average particle size determination for purposes of this specification is carried out by a method which relies on light scattering.

Methods for determining particle size are discussed in books such as "Particle Size Analysis" by John D. Sockham and Edward G. Fochtman, Ann Arbor Science Publishers, Ann Arbor, MI, 1977, and "Particle Size Analysis," by M. J. Groves, Heyden & Son, Inc. Philadelphia, Pa. The method of particle size used in examples of this disclosure is based on the technique of laser light scattering. This technique is discussed in publications such as "Rapid Analysis of Particle Size Distributions by Laser Light Scattering," by E. L. Weiss and H. N. Frock, Power Technology, 14, 287–293 (1976) and "Light Scattering Measurements of Particle Distributions" by A. L. Wertheimer and W. L. Wilcock, American Optics, 15, 1616–1620 (1976). Instruments based on this principle, called Microtrac Particle Size Analyzer, are manufactured by Leeds and Northrup, North Wales, Pa.

Throughout this specification and claims, a hydrocarbyl group, radical or molecule means a group, radical or molecule which consists essentially of carbon and hydrogen.

Specific embodiments of this invention given throughout this specification and especially in the examples are intended to be illustrative only. Variations on such specific embodiments are clear to one of skill in the art and are intended to be part of this invention.

EXAMPLE 1

Dry Grinding of Graphite

A synthetic graphite having a nominal size of 200 mesh was dry ground in an Allis Chalmer ball mill for different periods of time. The mill has a diameter of 15", length of 24" and has a small opening at one end to provide entrance of air to support oxidation. The Mill was charged with 320 pounds (lbs) of steel balls, composed of 80 lbs each of 5/32", 3/16", 7/32" and ¼" in diameter, and with 16.28 lbs of graphite. The speed of rotation was 48 RPM which was 70% of the critical speed, i.e., the speed at which the balls stop cascading or tumbling over themselves and, therefore, do not provide effective grinding action.

The progress of the grinding was followed by both the particle size and the oxygen content of the graphite. Particle size was determined by a Leeds and Northrup Microtrac Particle-Size Analyzer. This instrument provides information on particles size distribution in the range of 3–300 microns through laser beam scattering. Oxygen content of graphite was determined by heating the sample in a 750° C. tube furnace, splitting off all volatile oxygen compounds, sweeping them with helium to a reaction chamber held at 1060° C. which contained a large excess of active carbon. The latter converted all oxygen compounds into carbon monoxide which was determined quantitatively by gas chromatography. The oxygen content of the graphite was calculated from the carbon monoxide generated.

TABLE I

Effect of Dry Grinding Time on Particle Size and Oxygen Content

| Dry Grinding Time Hours | Particle Size by Microtrac, Micron 90% Passing | 50% Passing | % Oxygen |
|---|---|---|---|
| 0 | 54.2 | 17.5 | 0.20 |
| 3 | 27.5 | 11.7 | 0.36 |
| 6 | 17.3 | 8.6 | 0.37 |
| 12 | 15.2 | 7.2 | 0.80 |
| 24 | 13.5 | 6.3 | 1.21 |
| 48 | 10.3 | 5.5 | 1.94 |

TABLE I-continued

| Effect of Dry Grinding Time on Particle Size and Oxygen Content | | | |
|---|---|---|---|
| Dry Grinding Time | Particle Size by Microtrac, Micron | | |
| Hours | 90% Passing | 50% Passing | % Oxygen |
| 66 | — | 5.6 | 2.48 |

Table I shows the particle size and oxygen content of graphite as a function of dry grinding time. It can be seen from the table, and also from FIG. 1, that the particle size reduction was the greatest during the first six hours, after which increased grinding time showed very little effect on reducing the particle size. However, the oxygen content of the graphite continued to increase steadily for the entire 66 hour period.

EXAMPLE 2

Wet Grinding and Centrifugation Stability

This example shows that grinding beyond 6 hours in order to achieve the desired oxygen content is essential in achieving improved stability.

The dry ground graphite obtained from the grinding operation of Example 1 was evaluated for their suitability for subsequent processing steps by wet grinding in laboratory jar mills, followed by centrifugation.

A 1.33 gallon polyagonal jar mill (Model 861, Norton Company) was charged with 200 g of the dry-ground graphite. 150 g of Acryloid 940 and 500 g of a 150 SUS solvent treated paraffinic oil. About 22 lbs of ¼" steel balls were added and the jar was sealed. After grinding at 71 RPM (75% critical speed) for 24 hours another 150 g of Acryloid 940 was added and grinding continued for another 24 hours.

The dispersion obtained was placed in 100 ml centrifuge tubes and centrifuged for 18 hours at 900 RPM in an International Model BE Centrifuge. The graphite concentration of a 5 ml sample siphoned out of the middle of the tube was determined by ASTM Method D 524, the Ramsbottom Method of Carbon Residue. Results are shown in Table II.

TABLE II

| CENTRIFUGATION LOSS AS A FUNCTION OF DRY GRINDING TIME | | | | | | |
|---|---|---|---|---|---|---|
| Dry Grinding Time Hours | % O | Wet Grinding Time Hours | % Graphite Before Centri. | % Graphite After Centri. | Centri Loss % w* | Graphite Retention % w |
| 6 | 0.37 | 48 | 18.5 | 8.0 | 56.8 | 43.2 |
| 12 | 0.80 | 48 | 18.4 | 9.3 | 49.5 | 50.5 |
| 48 | 1.94 | 48 | 19.5 | 17.0 | 12.8 | 87.2 |
| 66 | 2.48 | 48 | 18.2 | 16.3 | 10.4 | 89.6 |

*Centrifugation loss is the difference in percent by weight of graphite in the dispersion before and after 18 hours of centrifugation at 900 rpm divided by the percent by weight of graphite in the dispersion before centrifugation. Graphite retention is the difference between 100 and centrifugation loss.

It can be seen from the table that the amount of graphite retained after centrifugation increased from 43.2% at 6 hours of dry grinding to 89.6% at 66 hours. This increased stability with dry grinding time cannot be attributed to reduced particle size, since data in Table I and the plot in FIG. 1 show that particle size reduction after 6 hours was quite small. On the other hand, substantial differences exist between the oxygen content of the graphite at 6 hours (0.37%) and 66 hours (2.48%).

FIG. 1 is a plot of the relationship between dry grinding time with particle size, oxygen content and the centrifugation stability. It clearly demonstrates the importance of controlling the oxygen content of graphite during dry grinding. Without following the oxygen content of graphite, one would normally stop the dry grinding at 6 or 12 hours, since not much further partical size reduction is evidenced. However, in so doing, one would end up with a dispersion of poor stability, as evidenced by the retention of only 43.2% to 50.5% of the graphite during centrifugation.

It is not certain why the increased oxygen content of the graphite improves the centrifugation stability. It is believed, however, that during dry grinding of graphite in a ball mill, the breakage of graphite particles is accompanied by the formation of reactive sites, favoring chemisorption of oxygen and the formation of polar oxygen-containing groups on the graphite surface. This will in turn favor the adsorption of polar compounds such as Acryloid 940 and render the latter more effective as a dispersant.

The oxygen content of graphite can be controlled by controlling the quantity of oxygen available during the dry grinding step. This can either be done by providing a suitable opening in the ball mill, or, as in the case of completely sealed ball mills, by periodically replenishing the atmosphere in the mill with air, oxygen or their mixture.

EXAMPLE 3

Dry Grinding of Graphite with Periodical Replenishment of Air

This Example 3 and Examples 4–5 deal with experiments establishing workable ways of controlling oxygen content of ground graphite.

A 0.5 gallons porcelain ball mill was charged with 0.25 gallons of ¼" stainless steel balls and 100 grams of 200 mesh synthetic graphite. The mill cover was tightly placed. The graphite was ground for a period of 72 hours at a speed of 60 RPM. At the end of each 24 hours, the cover was loosened and the slight vacuum in the mill was broken by admitting fresh air. A sample of graphite was also taken to determine its oxygen content. The oxygen content in percent by weight of the total weight of the graphite including oxygen was found to be 0.94, 2.30 and 2.38 at end of 24, 48 and 72 hours, respectively.

EXAMPLE 4

Dry Grinding of Graphite with Replenishment with Air-Oxygen Mixture

A 1.33 gallon porcelain ball mill was charged with 0.5 gallons of ¼" stainless steel balls and 100 grams of 200 mesh synthetic graphite. The mill cover was equipped with a ¼" steel pipe and a needle valve. After sealing the cover, the mill was evacuated three times, each followed by recharging to atmospheric pressure with a mixture of air and oxygen containing 40% oxygen. The grinding was carried out for a period of 48 hours. At the end of 24 hours, the mill was again evacuated and recharged with the air/oxygen mixture. The graphite obtained in this experiment contained 3.07 and 6.18% oxygen after 24 and 48 hours.

EXAMPLE 5

Dry Grinding of Graphite with Insufficient Oxygen

A 1.4 gallon porcelain ball mill was charged with 2675 ml of ¼" stainless steel balls and 800 grams of 200 mesh synthetic graphite. The mill was sealed and the graphite was ground for a period of 48 hours. At the end of every 12 hours, the cover was loosened to admit fresh air. The graphite obtained in this experiment was found to contain 0.24, 0.44, 0.68 and 0.82% oxygen at end of 12, 24, 36 and 48 hours.

Examples 3–5 show that the oxygen content of graphite obtained in the dry grinding step is highly dependent on the availability of oxygen, that it increases with increased free space in the mill per unit weight of graphite and with increased oxygen concentration in the free space. In a commercial operation, it is believed that the easiest way to control oxygen content is by providing a controlled access of air through a properly designed opening in the mill. The size of this opening will be necessarily dependent on the design of the ball mill and the flow rate of the graphite through the mill. But, the oxygen content of graphite can be monitored by taking samples and analyzing them by the method disclosed in Example 1.

On the other hand, experiments have indicated that the oxygen content of graphite cannot be readily increased in the absence of grinding. Literature indicates that graphite is resistant to oxidation by air up to 600° C. and above this temperature any oxidation product formed on the surface will be decomposed to carbon monoxide and carbon dioxide. Thus, any attempt to increase the oxygen content of graphite by air oxidation without grinding is believed to be futile.

EXAMPLE 6

Attempted Oxidation of Dry Ground Graphite

A fluidized bed reactor was constructed from a vertical quartz tube with an I.D. of 3¼" and height of 48". A feed of 300 grams of graphite which was dry ground for 24 hours in a 15" ball mill (see Example 1) was placed on a quartz frit. The frit was 10" above the bottom of the tube and the graphite occupied a height of about 18". The reactor was surrounded by a tube furnace. Filtered compressed air at 15–20 psig was passed through the graphite bed at a rate of 60–75 liters/hours (calibrated to STP). The graphite did not fluidize well and had to be stirred with a mechanical stirrer at about 60 RPM to avoid channeling. Two experiments were conducted, one at 120° F. and one at 300° F., and both for a period of 25 hours. Results are shown in TABLE III.

TABLE III

| Experiment | Temperature % F | Time Hrs. | % Oxygen Feed | % Oxygen Product |
|---|---|---|---|---|
| 1 | 120 | 25 | 1.21 | 1.32 |
| 2 | 300 | 25 | 1.21 | 1.22 |

These results clearly indicate that no significant oxidation was achieved under the experimental conditions. It is believed that oxidation of graphite during grinding is achieved by the breaking of C—C bonds, creating reactive sites and causing the irreversible chemisorption of oxygen. This series of events are not encountered in the absence of fracturing.

The invention which is claimed is:

1. A method for improving the yield and stability of a graphite-in-oil dispersion comprising: grinding graphite to form graphite particles having an average diameter in the range from about 2 microns to about 15 microns in the presence of an oxygen-containing atmosphere so that said graphite particles have an oxygen content in the range of about 1% to about 7% of total weight of the graphite particle including oxygen, and dispersing at least a portion of said graphite particles into an oil to form a graphite-in-oil dispersion.

2. The method of claim 1, wherein said grinding comprises ball milling in the presence of a sufficient amount of oxygen-containing atmosphere for a residence time sufficient to cause said graphite particles to form graphite particles having said oxygen content and said average diameter in said ranges.

3. The method of claim 2, wherein said residence time is in excess of about 12 hours and less than about 72 hours.

4. The method of claim 1, wherein said dispersing involves ball milling for a residence time sufficient to disperse said graphite particles having an average diameter in the range of about 5 microns to about 10 microns to form a graphite-in-oil dispersion.

5. The method of claim 1 or 4, wherein particles having an average diameter in excess of about 6 microns are separated from said graphite-in-oil dispersion, whereby a very stable graphite-in-oil dispersion is formed.

6. The method of claim 1, 2, 3 or 4, wherein said oil used in said graphite-in-oil dispersion is selected from the group consisting of paraffinic and naphthenic lubricant base oils.

7. The method of claim 6, wherein there is added during said dispersing a dispersing amount of a material selected from the group consisting of:

(i) a copolymer of an N-vinyl pyrrolidone of the following formula:

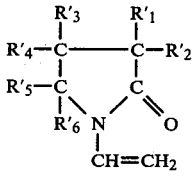

wherein $R_1'$, $R_2'$, $R_3'$ $R_4'$, $R_5'$, and $R_6'$ are independently selected from the group consisting of hydrogen and a hydrocarbyl radical containing from 1 to 4 carbon atoms; and an acrylate ester of the following formula:

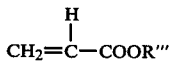

wherein R''' is selected from the group of oil solubilizing hydrocarbyl radicals containing about 8 to about 24 carbon atoms having a molecular weight in the range of about 100,000 to about 1,000,000, wherein molar ratio of N-vinyl pyrrolidone to acrylate ester is in the range of about 1:5 to about 1:15;

(ii) a copolymer of a methacrylate ester and N-vinyl pyrrolidone of an average molecular weight of about 350,000 to about 600,000 corresponding to the formula:

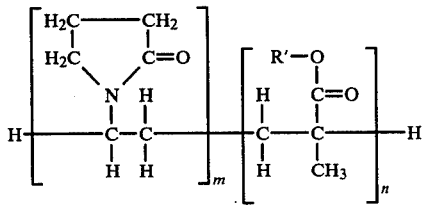

wherein R′ is a hydrocarbyl radical containing from 1 to about 22 carbon atoms; and the ratio of m:n is in the range of about 1:5 to about 1:15; and (iii) a graft copolymer consisting essentially of an oil soluble, substantially linear, rubbery hydrocarbon backbone polymer selected from ethylene/propylene copolymer and ethylene/propylene diene modified terpolymer, said backbone polymer having graft polymerized thereon monomer units selected from C-vinylpyridines and N-vinylpyrrolidone.

* * * * *